United States Patent [19]

Eales

[11] 4,078,903

[45] Mar. 14, 1978

[54] COAL GASIFICATION

[75] Inventor: David Frank Eales, Kinross, Scotland

[73] Assignee: British Gas Corporation, England

[21] Appl. No.: 743,902

[22] Filed: Nov. 22, 1976

[30] Foreign Application Priority Data

Nov. 27, 1975 United Kingdom ..... 48809/75

[51] Int. Cl.[2] ..... B01J 3/00

[52] U.S. Cl. ..... 48/62 R; 48/77; 48/73; 48/DIG. 2; 110/266; 110/165 R; 432/14

[58] Field of Search ..... 48/77, 76, 62 R, 92, 48/63, 202, 210, 197 R, DIG. 2; 110/28 P, 165 R; 122/235 N; 432/14

[56] References Cited

U.S. PATENT DOCUMENTS

| | | | |
|---|---|---|---|
| 1,846,647 | 2/1932 | Leitch et al. | 110/28 P |
| 3,958,919 | 5/1976 | Kjell-Berger | 432/14 |

*Primary Examiner*—Robert L. Lindsay, Jr.
*Assistant Examiner*—George C. Yeung
*Attorney, Agent, or Firm*—Larson, Taylor and Hinds

[57] ABSTRACT

In a slagging gasifier the slag quenching chamber is provided with means having a plurality of equispaced outlet ports disposed around the inside of the upper region of the chamber, each outlet port communicating with a venting control which may be used selectively to vent the normally pressurized quenching chamber to atmosphere during a slag-tapping operation.

8 Claims, 4 Drawing Figures

COAL GASIFICATION

Figure 1:
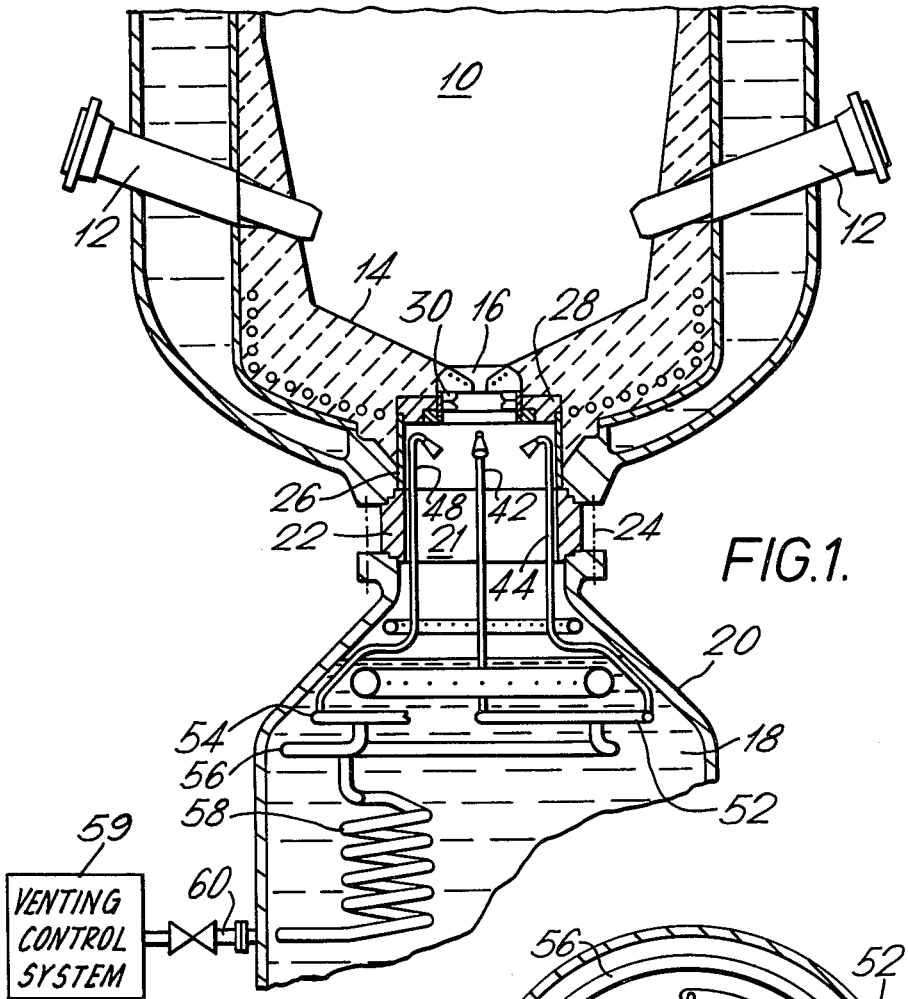

This invention relates to coal gasification plant, and more particularly to a quenching chamber arrangement for use in slagging gasifier plants of the kind (hereinafter referred to as the kind specified) in which coal, or other carbonaceous fuel, is introduced into the top of a column-like gasifying vessel and is gasified under high pressure and temperature by means of a gas, for example oxygen and steam, introduced into the fuel bed through tuyeres. The residual ash collects as a molten slag and iron in the hearth of the gasifier vessel from which it is periodically discharged (commonly known as slag-tapping) downwardly through a slag tap outlet or orifice in the hearth into water contained in a quenching chamber vessel. Usually, a pool of molten slag and iron is maintained in the hearth by directing hot combustion products from a burner located beneath the slag tap orifice up the tap orifice to retain the pool of slag and iron in the hearth, the tapping of the molten slag and iron being initiated and controlled by stopping or reducing the burner output and reducing the pressure in the quenching chamber by controlled venting through its venting system so as to produce a differential pressure between the quenching chamber and the gasifier vessel.

Examples of such slagging gasifier plant are those disclosed in United Kingdom Patent Specification No. 977,122, The Gas Council Research Communication No's GC 50 and GC 112.

Ideally, during a slag-tapping operation, the molten slag should run from the tap in a vertical stream before being quenched rapidly at the water surface in the quenching chamber. It has been found that any uneven loading of the main slag tap burner or any undesirable burner product flow patterns in the upper part of the chamber, particularly across the face of the burner, can cause displacement of the slag stream with consequential splattering thereof to such an extent that the burner, services to and from the chamber, together with its upper walls, became coated with slag.

An object of the present invention is to provide an improved venting arrangement for the pressurised gases in the quenching chamber of a slagging gasifier designed to reduce any tendency to uneven gas flow patterns therein.

According to the invention, in a slagging gasifier of the kind specified, the quenching chamber is provided with venting means comprising a plurality of equispaced vent ports disposed around the inside of the upper region of the said chamber, and means communicating said vent ports with said venting control means arranged is use of the gasifier to produce a balanced outflow of gases at each vent port during a pressure-reducing venting operation of the quenching chamber.

The disposal of venting ports around the chamber can take any convenient form designed to ensure an even discharge flow pattern of burner products and other gases from the chamber during venting. For example, the venting means could consist of a plurality of individual pipes, for example standpipes, equispaced around said upper region of the chamber and each having one or more said vent ports. Alternatively, the venting means could consist of a tubular annulus provided with said plurality of vent ports equispaced around its peripheral surface.

In either case, the venting means preferably communicates with said venting control system through the intermediary of interconnecting pipelines most of which are arranged to be immersed in said water contained in said quenching chamber vessel whereby, in use of the gasifier, to cool the hot gases passing to said venting control system from the vent ports which might otherwise cause damage to the controls of the venting system.

Figure 2:
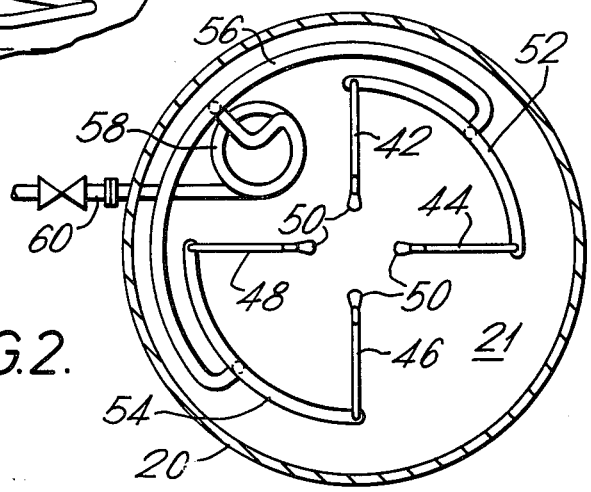
Figure 3:
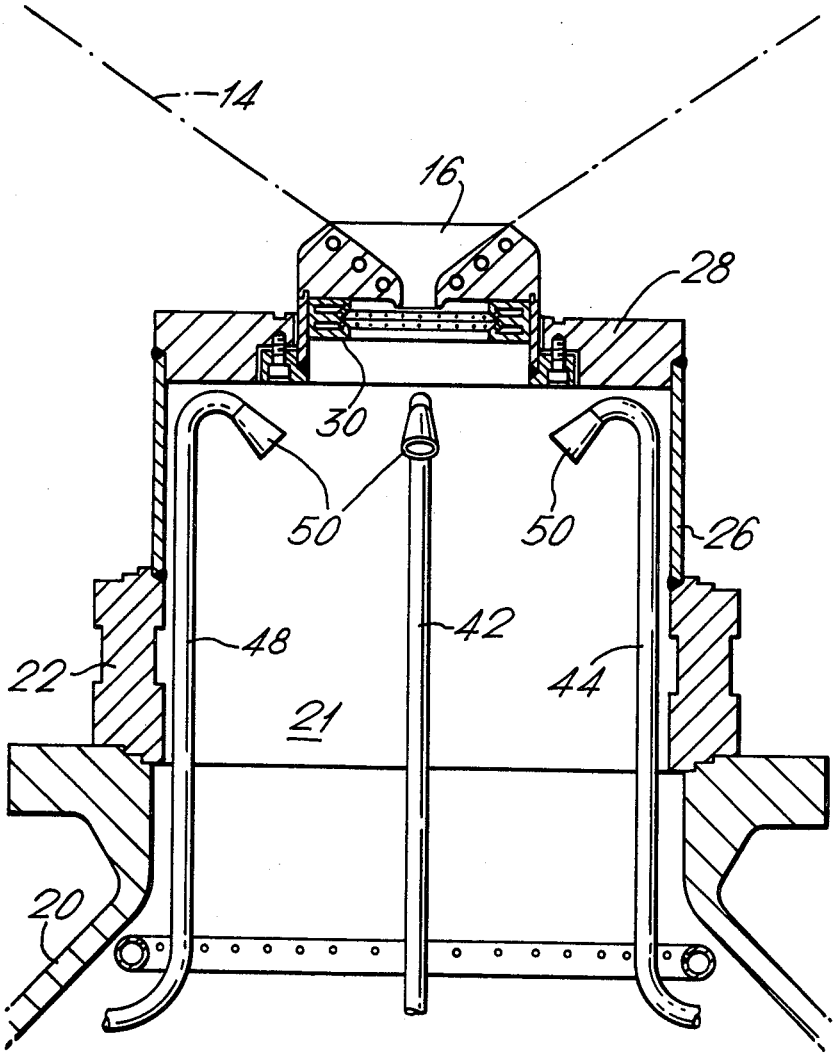
Figure 4:
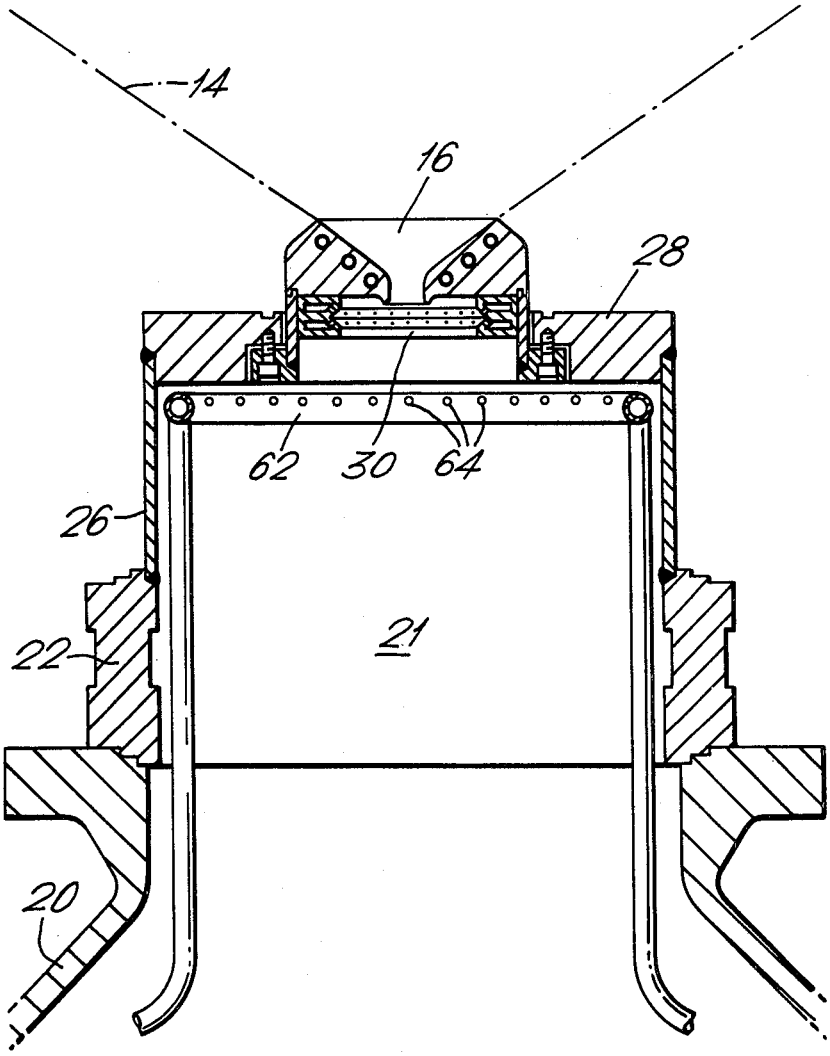

Embodiments of the invention will now be described, by way of example, with reference to the accompanying diagrammatic drawings in which:

FIG. 1 is a general longitudinal sectional elevation of part of a fixed-bed slagging gasifier showing one embodiment of a quench chamber venting arrangement, FIG. 2 is a sectional plan view of the arrangement shown in FIG. 1, FIG. 3 is an enlarged longitudinal sectional elevation of the upper region of the quenching chamber shown in FIG. 1, and FIG. 4 is a similar view to FIG. 3, but showing an alternative embodiment of a quench chamber venting arrangement.

Referring first to the FIG. 1, the gasifier has a refractorylined pressurised gasification chamber 10 into which coal is fed from the top, oxygen and steam are introduced into the fuel bed (not shown) through tuyeres 12 to promote gasification of the coal. In use of the gasifier, a reservoir or pool of molten slag and iron collects on the sloping hearth 14 and is periodically discharged, (commonly known as slag-tapping) through an orifice formed in a slag tap 16, into a water reservoir 18 contained in a quenching chamber vessel 20 where it is rapidly quenched before being transferred to a lock hopper (not shown) in the form of a dense small-grained frit. The quenching chamber vessel 20 is attached to the bottom end of the gasification chamber 10 through the intermediary of an associated spacing member or sandwich flange 22 and clamping means, shown schematically at 24. The interior of the vessel 20 and sandwich flange 22 defines a quenching chamber 21.

Referring also to FIG. 3, a metal tube 26 is fixed to, and extends upwardly from, the flange 22 and is fixed at its upper end to an annular metal block 28 which is arranged to support a ring-like nozzle-mix gas/air burner 30 concentrically beneath the slag tap 16.

Referring also to FIG. 2, the pressurised quenching chamber 21 is vented to atmosphere during a slag-tapping operation by means of four standpipes 42, 44, 46 and 48 disposed beneath the annular block 28 at equispaced positions within the chamber. Each standpipe is provided with an inwardly and downwardly directed venting port 50 at its upper end for preventing slag from blocking the port. The pairs of standpipes 42, 44 and 46, 48 communicate with respective arcuate conduits 52 and 54 which, in turn, communicate with a manifold 56.

In operation of the gasifier, particularly during slag-tapping, the standpipes can become heated possibly to incandescence with the result that the temperature of the vented gases flowing through the pipes will be excessive and likely to cause damage to the controls of the venting system. It is desirable, therefore, to dissipate some of the heat by way of a heat-exchanger 58 in the form of a coiled pipe which, together with the manifold 56 (with which it communicates) and the arcuate conduits 52, 54, are immersed in the water reservoir 18. The vent standpipes communicate (via the manifold 56, conduits 52, 54 and coiled pipe 58) with a venting control system (shown diagrammatically at 59) via a pipeline 60 carried through the quenching vessel 20.

It will be appreciated that other arrangements of venting means of different construction and/or disposed at any other suitable region of the upper part of the quenching chamber can be used without departing from the scope of the present invention. Accordingly, for example, in an alternative arrangement shown in FIG. 4, the evenly distributed venting of the chamber to atmosphere is achieved by means of a tubular ring 62 disposed beneath the annular block 28 having a plurality of equispaced outlet ports 64 at any suitable positions around the ring. The vent tube 62 communicates with a heat-exchange arrangement (not shown) and a venting control system (not shown) in a manner similar to that already described.

With these arrangements, the flow of gases from the chamber 21 during venting is evenly distributed through the ports 50 or 64 so as not to create undesirable flow patterns across the face of the burner 30.

I claim:

1. A slagging gasifier comprising, a gasifying vessel, means for introducing coal into said vessel for gasification thereof in said vessel, means for introducing oxygen and steam into said vessel to effect gasification of coal therein, a hearth located at the bottom of said vessel and including a slag removal orifice for removing slag therefrom, a burner located beneath said slag removal orifice for directing hot combustion products up the orifice so as to maintain a pool of molten slag in said hearth, and a quenching chamber vessel into which molten slag is periodically discharged from said hearth through said slag removal orifice by the controlled stopping or reducing the burner output and by reducing the pressure in said quenching chamber so as to produce a differential pressure between said quench chamber vessel and said gasifying vessel, the improvement wherein said quenching chamber is provided with venting means comprising a plurality of equispaced vent ports disposed around the inside of the upper region of said quenching chamber, a venting control means, and means, communicating said vent ports with said venting control means, for producing, in use of the gasifier, a balanced outflow of gases at each vent port during a pressure-reducing operation of the quenching chamber.

2. A slagging gasifier according to claim 1, wherein the venting means consists of a plurality of individual pipes equispaced around said upper region of the chamber, each pipe having one or more said vent ports.

3. A slagging gasifier according to claim 2, wherein each individual pipe is in the form of a substantially vertical standpipe with said vent port or ports formed at its upper end.

4. A slagging gasifier according to claim 1, wherein said venting means consists of a tubular annulus provided with said plurality of vent ports equispaced around its peripheral surface.

5. A slagging gasifier according to claim 1 wherein the venting means communicates with said venting control system through the intermediary of interconnecting pipelines most of which are arranged to be immersed in water contained in said quenching chamber vessel whereby, in use of the gasifier, to cool the hot gases passing to said venting control system from the vent ports.

6. A slagging gasifier according to claim 5, wherein the interconnecting pipelines includes said means for producing a balanced outflow of gases at each vent port, which gas outflow-balancing means comprises at least two conduits each arranged to communicated with an equal number of said vent ports, and a manifold arranged to communicate the conduits with said venting control means.

7. A slagging gasifier according to claim 5 wherein those interconnecting pipelines which are normally immersed in water include a heat-exchanger for cooling the hot gases vented through the vent ports.

8. A slagging gasifier according to claim 7, wherein the heat-exchanger is in the form of a coiled pipe.

* * * * *